US009194251B2

(12) United States Patent
McMahon et al.

(10) Patent No.: US 9,194,251 B2
(45) Date of Patent: Nov. 24, 2015

(54) DUCT DAMPER

(75) Inventors: Ryan C. McMahon, North Palm Beach, FL (US); Robert J. Sayers, East Hartford, CT (US); Steven W. Burd, Cheshire, CT (US)

(73) Assignee: United Technologies Corporation, Hartford, CT (US)

( * ) Notice: Subject to any disclaimer, the term of this patent is extended or adjusted under 35 U.S.C. 154(b) by 885 days.

(21) Appl. No.: 13/571,625

(22) Filed: Aug. 10, 2012

(65) Prior Publication Data

US 2014/0099182 A1 Apr. 10, 2014

(51) Int. Cl.
*F01D 25/00* (2006.01)
*F01D 25/04* (2006.01)

(52) U.S. Cl.
CPC ..... *F01D 25/04* (2013.01)

(58) Field of Classification Search
CPC ..... F01D 25/04; F01D 25/24
See application file for complete search history.

(56) References Cited

U.S. PATENT DOCUMENTS

| | | | | |
|---|---|---|---|---|
| 4,016,718 | A | 4/1977 | Lauck | |
| 4,297,843 | A | 11/1981 | Sato et al. | |
| 4,833,881 | A | 5/1989 | Vdoviak et al. | |
| 5,201,887 | A | 4/1993 | Bruchez, Jr. et al. | |
| 5,429,477 | A * | 7/1995 | Sikorski et al. | 415/119 |
| 5,489,202 | A | 2/1996 | Eisinger | |
| 5,950,970 | A | 9/1999 | Methany et al. | |
| 6,038,862 | A | 3/2000 | Melman et al. | |
| 7,220,916 | B2 * | 5/2007 | Schwamborn et al. | 174/110 R |
| 7,600,370 | B2 | 10/2009 | Dawson | |
| 2003/0136101 | A1 | 7/2003 | Nishimura et al. | |
| 2009/0004000 | A1 * | 1/2009 | Baumhauer et al. | 415/209.3 |
| 2009/0053050 | A1 * | 2/2009 | Bruce et al. | 415/200 |
| 2010/0232954 | A1 * | 9/2010 | Clemen | 415/199.4 |
| 2010/0284790 | A1 | 11/2010 | Pool et al. | |
| 2012/0186269 | A1 * | 7/2012 | Cihlar et al. | 60/796 |

* cited by examiner

*Primary Examiner* — Edward Look
*Assistant Examiner* — Cameron Corday
(74) *Attorney, Agent, or Firm* — Carlson, Gaskey & Olds, P.C.

(57) ABSTRACT

An example damper includes a damping member configured to damp a duct wall at an interface between a duct band and the duct wall.

18 Claims, 3 Drawing Sheets

DUCT DAMPER

STATEMENT REGARDING FEDERALLY SPONSORED RESEARCH OR DEVELOPMENT

This invention was made with government support under Contract No. N00019-02-C-3003 awarded by the United States Navy. The Government has certain rights in this invention.

BACKGROUND

This disclosure relates generally to damping vibrations, more particularly, to a damping member for use in connection with a duct band.

Turbomachines, such as gas turbine engines, typically include a fan section, a compression section, a combustor section, and a turbine section. During operation, flow enters the turbomachine through the fan section. Some of the flow moves along a core flowpath within a core engine portion of the turbomachine. Some of the flow moves along a bypass flowpath radially outside the core engine portion. A duct wall is positioned between the core engine flowpath and the bypass flowpath.

Some turbomachines include duct bands that radially compresses the duct wall to damp vibrations associated with the duct. The duct band directly interfaces with a radially outwardly facing surface of the duct. That is, the duct band contacts the duct.

SUMMARY

A damper according to an exemplary aspect of the present disclosure includes, among other things, a damping member configured to damp a duct wall at an interface between a duct band and the duct wall.

In a further non-limiting embodiment of the foregoing damper, the damping member may comprise a viscoelastic material.

In a further non-limiting embodiment of either of the foregoing dampers, the damping member may comprise a synthetic polymer material.

In a further non-limiting embodiment of any of the foregoing dampers, the damping member may comprise a metallic structure.

In a further non-limiting embodiment of any of the foregoing dampers, the damping member may comprise a synthetic fluoropolymer.

In a further non-limiting embodiment of any of the foregoing dampers, the damping member may be secured directly to the duct band such that the damping member moves with duct band as the duct band is moved relative to the duct wall.

In a further non-limiting embodiment of any of the foregoing dampers, the damping member may be an annular damping member and may provide a plurality of radially extending apertures.

In a further non-limiting embodiment of any of the foregoing dampers, the duct band may engage the duct wall exclusively through the damping member.

In a further non-limiting embodiment of any of the foregoing dampers, the damping member may cover an inwardly facing surface of the duct band.

A turbomachine damping assembly according to another exemplary aspect of the present disclosure includes, among other things, a duct wall between a core flowpath and a bypass flowpath of a turbomachine, a duct band disposed about a radially outer surface of the duct wall, and a damping member between the duct wall and the duct band.

In a further non-limiting embodiment of the foregoing turbomachine damping assembly, the duct wall, the duct band, and the damping member may each provide apertures configured to communicate flow between the core flowpath and the bypass flow path.

In a further non-limiting embodiment of either of the foregoing turbomachine damping assemblies, the assembly may include an actuation system that moves the duct band relative to the duct wall to selectively adjust flow through the apertures.

In a further non-limiting embodiment of any of the foregoing turbomachine damping assemblies, the damping member may be secured to the duct band such that the damping member moves with the duct band.

In a further non-limiting embodiment of any of the foregoing turbomachine damping assemblies, the duct band may be positioned axially forward an augmentor section of the turbomachine.

In a further non-limiting embodiment of any of the foregoing turbomachine damping assemblies, the duct band may be positioned axially rearward a combustor section of a turbomachine.

In a further non-limiting embodiment of any of the foregoing turbomachine damping assemblies, the duct band may be configured to apply a radially inward clamp load to the duct wall.

In a further non-limiting embodiment of any of the foregoing turbomachine damping assemblies, an attachment assembly may be configured to exert a circumferentially directed load to hold opposing circumferentially ends of the duct band relative to each other.

In a further non-limiting embodiment of any of the foregoing turbomachine damping assemblies, the attachment assembly may comprise radially extending flanges and a spring biasing device configured to bias the flanges circumferentially toward each other.

A method of damping a turbomachine interface according to another exemplary aspect of the present disclosure includes, among other things, separating a duct band from a duct wall using a damper member.

In a further non-limiting embodiment of the foregoing method of damping a turbomachine interface, the method may include communicating a flow between a bypass flow path and a core flow path of a turbomachine through apertures in each of the duct band, the duct wall, and the damper member.

In a further non-limiting embodiment of the either of the foregoing methods of damping a turbomachine interface, the damper member may be positioned radially between the duct band and the damper member.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
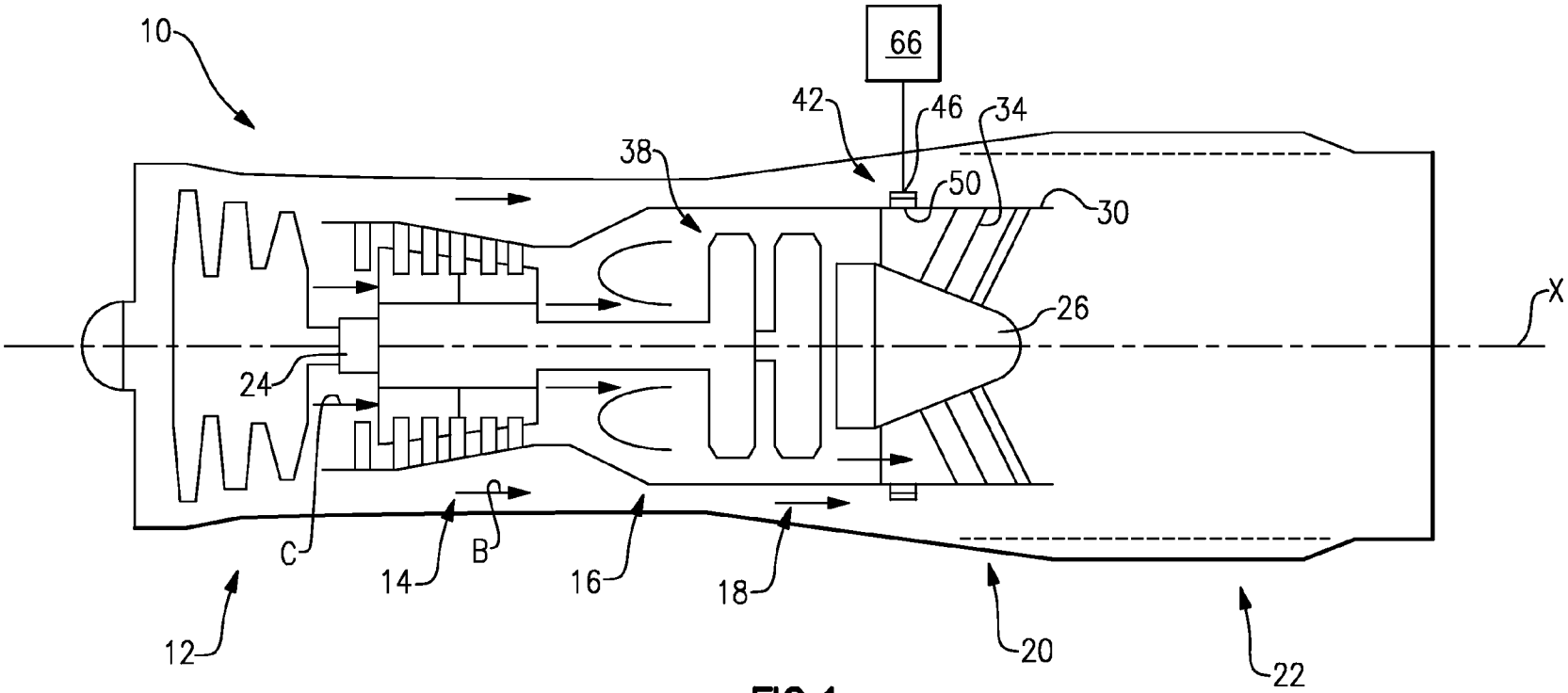
FIG. 1 shows a schematic side view of an example turbomachine.
Figure 2:
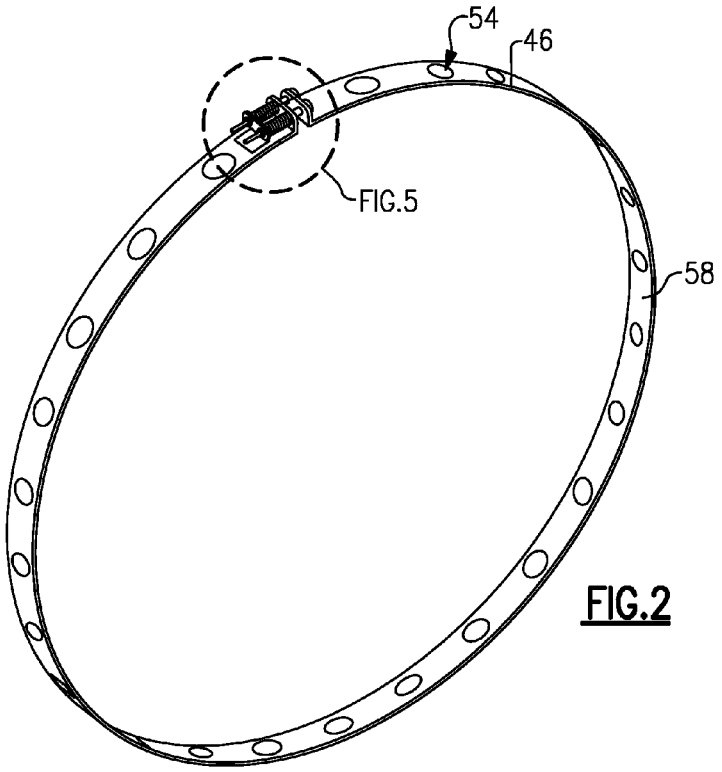
FIG. 2 shows a perspective view of a duct band within the turbomachine of FIG. 1.
Figure 3:
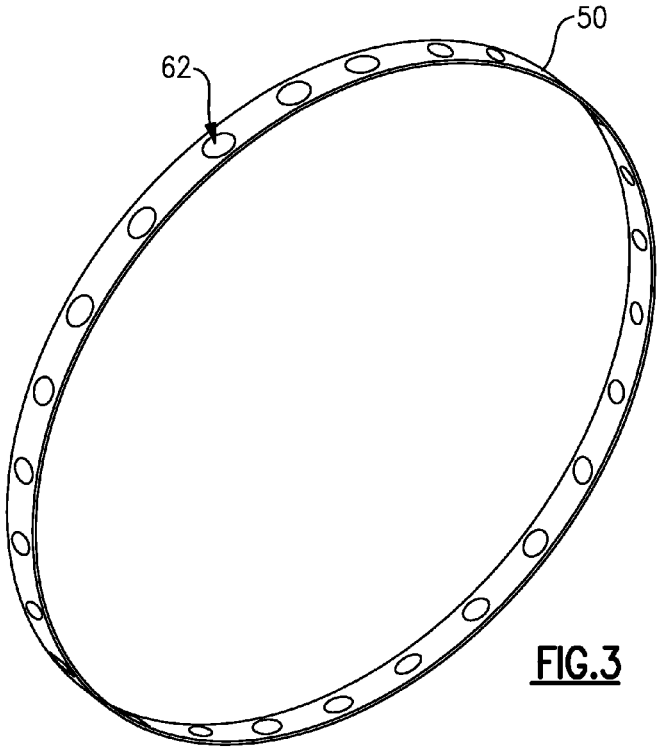
FIG. 3 shows a perspective view of a damping member used with the duct band of FIG. 2.
Figure 4:
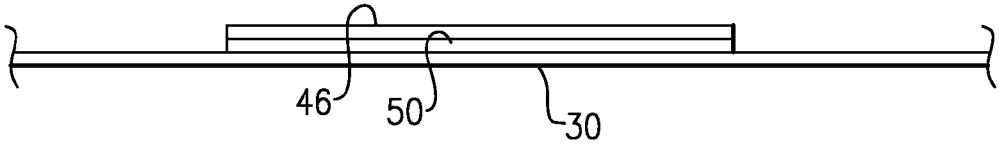
FIG. 4 shows a section view of the duct band and the damping member in the turbomachine of FIG. 1.
Figure 5:
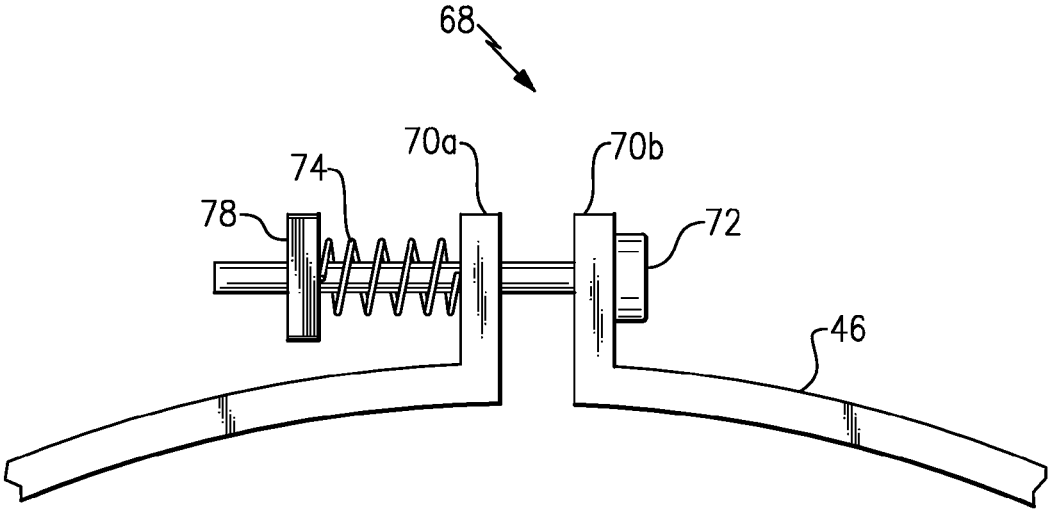
FIG. 5 shows a close up view of area 5 in FIG. 2.

Referring to FIG. 1, an example turbomachine 10 includes a fan section 12, a compressor section 14, a combustor section 16, a turbine section 18, an augmentor section 20 (in some applications), and an exhaust section 22. The compressor section 14, combustor section 16, and turbine section 18 are generally referred to as the core engine. The turbomachine 10 extends longitudinally along an axis X.

Although depicted as a two-spool gas turbine engine in the disclosed non-limiting embodiment, it should be understood that the concepts described herein are not limited to use with two-spool designs. That is, the teachings may be applied to other types of turbomachines and gas turbine engines, including three-spool architectures.

In the example turbomachine 10, flow moves from the fan section 12 to a bypass flow path B. Flow from the bypass flow path generates forward thrust.

The compressor section 14 drives flow along a core flow path C within the core engine of the turbomachine 10. Compressed air from the compressor section 14 communicates through the combustor section 16. The products of combustion are expanded through the turbine section 18.

In some examples, the turbomachine 10 may incorporate a geared architecture 24 that allows a fan of the fan section 12 to rotate at a slower speed than a turbine that is driving the fan. The geared architecture 24 may include an epicyclic geartrain, such as a planetary geartrain, or some other gear system.

A bypass section of the example turbomachine 10 includes an inner duct wall 26, an outer duct wall 30, and an annular array of vanes 34 extending radially therebetween.

The outer duct wall 30 is part of the turbine section 18, augmentor section 20, or exhaust section 22. Generally, the outer duct wall 30 separates the core flow path C from a bypass flow path B.

A duct band 46 is radially outside the outer duct wall 30. The duct band 46 exerts a clamping load that urges the outer duct wall 30 radially toward the axis X. The clamp load helps damp vibrations of the outer duct wall 30 and other components.

A damping member 50 is located radially between the outer duct wall 30 and the duct band 46. The damping member 50 is held against the outer duct wall 30 by the duct band 46. The damping member 50 helps to damp vibrations by, for example, deadening responses to acoustic input. The damping member 50 thus lessens the vibrations communicated between the outer duct wall 30 and other components.

The duct band 46 may be coated with a protective material. As can be appreciated, the damping member 50 is different than such a protective material because the damping member 50 helps to damp vibrations. A coating of an exclusively protective material would not damp in this way. Damping materials, in some examples, are elastomer or viscoelastic materials that accommodate loads and are compliant when deformed. In another example, the damping material may be a solid ceramic material.

In this example, the duct band 46 and the damping member 50 are positioned axially forward the augmentor section 20. The duct band 46 and the damping member 50 are also axially rearward the turbine section 18 of the turbomachine 10. The duct band 46 and the damping member 50 are also axially rearward the combustor section 16 of the turbomachine 10.

Referring now to FIGS. 2-5 with continuing reference to FIG. 1, the example duct band 46 includes a plurality of radially extending apertures 54 distributed circumferentially about the axis X. The damping member 50 includes a plurality of radially extending apertures 62 distributed annularly about the axis X.

In this example, the damping member 50 is secured directly to an inwardly facing surface 58 of the duct band 46. An adhesive may be used to secure the damping member 50. The apertures 62 remain aligned with the apertures 54 throughout operation as there substantially no relative movement between the example damping member 50 and the example duct band 46.

The turbomachine 10 includes an actuation system and linkage assembly 66 that is operative to rotate the duct band 46 and the damping member 50 relative to the outer duct wall 30. Rotating the duct band 46 and the damping member 50 aligns and misaligns the apertures 54 and 62 with apertures (not shown) in the outer duct wall 30.

When the apertures 54 and the apertures 62 are aligned with apertures in the outer duct wall 30, flow is able to move between the bypass flow path 42 and the core flow path 38. Flow moving between the bypass flow path 42 and the core flow path 38 may be desirable for engine performance enhancements for example.

A person having skill in this art and the benefit of this disclosure would understand how to provide the actuation system and linkage assembly 66 for manipulating the circumferential position of the duct band 46 and the damping member 50 relative to the outer duct wall 30 to selectively permit and restrict flow through the apertures 54 and the apertures 62.

In other examples, the damping member 50 may be secured directly to the outer duct wall 30 rather than the duct band 46. In such examples, the duct band 46 rotates relative to the damping member 50 to selectively move flow through the apertures 54.

The damping member 50 may be any material suitable for deadening vibrations. In some examples, the damping member 50 is a viscoelastic material, such as silicone. In another example, the damping member 50 is a synthetic polymer, such as rubber. In still other examples, the damping member may be a synthetic fluoropolymer material, such as polytetrafluoroethylene. In still other examples, the damping member 50 may be a metallic structure, such as a metal mesh or a metal weave that is compliant to loading and compression.

The example duct band 46 has a relatively planar cross-section. The duct band 46 and the damping member 50 both terminate axially at about the same position. In other examples, the damping member 50 may extend axially past the duct band 46, or vice versa.

An attachment assembly 68 holds the position of the duct band 46. The attachment assembly 68 includes radially extending flanges 70*a* and 70*b*, which are located at opposing ends of the duct band 46. The flanges 70*a* and 70*b* provide apertures that receive a fastener 72, such as a bolt. The example fasteners 72 are received within a spring 74 in addition to the apertures in the flanges 70*a* and 70*b*. The spring 74 extends from the flange 70*a* to a plate 78. The fasteners 72 are tightened to the plate 78, which compresses the spring 74. The attachment assembly is a relatively flexible arrangement for securing the duct band 46 accommodates movements of the duct band 46. As may be appreciated, the attachment assembly exerts a circumferentially directed load to hold opposing circumferentially ends of the duct band 46 relative to each other.

To remove the duct band 46 and the damping member 50, the fasteners 72 are loosened. The duct band 46 and damping member 50 are then slid rearwardly over the outer duct wall 30. The attachment assembly 68 concept facilitates relatively quick change out of the damper member 50 if the damping member 50 becomes worn.

Features of the disclosed embodiments includes a duct band and damping member that provides vibrational and acoustical damping. The duct band and damping member also provide structural rigidity to the clamped component. The damping member may mitigate wear.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A damper comprising:

a duct band; and a damping member secured directly to the duct band and moveable together with the duct band relative to a duct wall, and configured to damp the duct wall at an interface between the duct band and the duct wall, wherein the damping member is an annular damping member and provides a plurality of radially extending apertures configured to communicate flow.

2. The damper of claim 1, wherein the damping member comprises a viscoelastic material.

3. The damper of claim 1, wherein the damping member comprises a synthetic polymer material.

4. The damper of claim 1, wherein the damping member comprises a metallic structure.

5. The damper of claim 1, wherein the damping member comprises a synthetic fluoropolymer.

6. The damper of claim 1, wherein the duct band engages the duct wall exclusively through the damping member.

7. The damper of claim 1, wherein the damping member covers an inwardly facing surface of the duct band.

8. The damper of claim 1, wherein the damping member extends circumferentially about an axis.

9. The damper of claim 1, further comprising an attachment assembly configured to exert a circumferentially directed load to hold opposing circumferential ends of the duct band relative to each other.

10. A turbomachine damping assembly, comprising:

a duct wall between a core flowpath and a bypass flowpath of a turbomachine;

a duct band disposed about a radially outer surface of the duct wall; and a damping member between the duct wall and the duct band, wherein the duct wall, the duct band, and the damping member each provide apertures configured to communicate flow between the core flowpath and the bypass flow path.

11. The turbomachine damping assembly of claim 10, including an actuation system that moves the duct band relative to the duct wall to selectively adjust flow through the apertures.

12. The turbomachine damping assembly of claim 11, wherein the damping member is secured to the duct band such that the damping member moves with the duct band.

13. The turbomachine damping assembly of claim 10, wherein the duct band is positioned axially rearward a combustor section of a turbomachine.

14. The turbomachine damping assembly of claim 10, wherein the duct band is configured to apply radially inward clamp load to the duct wall.

15. The turbomachine damping assembly of claim 10, including an attachment assembly configured to exert a circumferentially directed load to hold opposing circumferential ends of the duct band relative to each other.

16. The turbomachine damping assembly of claim 15, wherein the attachment assembly comprises radially extending flanges and a spring biasing device configured to bias the flanges circumferentially toward each other.

17. A method of damping a turbomachine interface comprising:

spacing a duct band from a duct wall using a damper member; and communicating a flow between a bypass flow path and a core flow path of a turbomachine through apertures in each of the duct band, the duct wall, and the damper member.

18. The method of claim 17, wherein the damper member is positioned radially between the duct band and the duct wall.

* * * * *